US008082856B1

(12) United States Patent
Hayden et al.

(10) Patent No.: US 8,082,856 B1
(45) Date of Patent: Dec. 27, 2011

(54) LID ASSEMBLY FOR BUILT-IN POWER AND COMMUNICATION OUTLET UNIT

(75) Inventors: Russell Hayden, Stratford, CT (US); Glenn Golden, Wallingford, CT (US); Dave Black, Orange, CT (US)

(73) Assignee: Premier Manufacturing Group, Inc., Shelton, CT (US)

( * ) Notice: Subject to any disclaimer, the term of this patent is extended or adjusted under 35 U.S.C. 154(b) by 732 days.

(21) Appl. No.: 12/127,275

(22) Filed: May 27, 2008

Related U.S. Application Data

(60) Provisional application No. 60/933,180, filed on Jun. 5, 2007.

(51) Int. Cl.
*A47B 37/00* (2006.01)

(52) U.S. Cl. ..... 108/50.01; 108/25; 312/223.6

(58) Field of Classification Search ..... 108/25, 108/50.01, 50.02, 26; 312/223.1, 223.6, 312/223.3, 223.2, 293.2; 439/142, 131; 248/917, 248/923
See application file for complete search history.

(56) References Cited

U.S. PATENT DOCUMENTS

| | | | | | |
|---|---|---|---|---|---|
| 993,588 | A * | 5/1911 | Donning | 312/208.1 |
| 2,589,393 | A * | 3/1952 | James | 312/327 |
| 5,230,552 | A * | 7/1993 | Schipper et al. | 312/223.6 |
| 5,575,668 | A * | 11/1996 | Timmerman | 439/131 |
| 5,740,743 | A * | 4/1998 | Schairbaum | 108/25 |
| 5,878,673 | A * | 3/1999 | Kramer et al. | 108/50.02 |
| 6,553,919 | B1 * | 4/2003 | Nevin | 108/50.01 |
| 6,732,661 | B2 * | 5/2004 | Grasse et al. | 108/50.02 |
| 7,100,516 | B2 * | 9/2006 | Riddiford et al. | 108/50.01 |
| 7,578,243 | B2 * | 8/2009 | Gevaert | 108/25 |
| 7,784,412 | B2 * | 8/2010 | Korber et al. | 108/25 |
| 2003/0230222 | A1 * | 12/2003 | Liu | 108/50.01 |
| 2008/0115697 | A1 * | 5/2008 | Beam | 108/26 |

* cited by examiner

*Primary Examiner* — Jose V Chen
(74) *Attorney, Agent, or Firm* — Raymond A. Nuzzo

(57) ABSTRACT

A lid assembly for an outlet unit built into an article having a work surface, the power and communication outlet is positioned below an opening or cut-out in the work surface, the opening has an inner side that extends about the opening. The lid assembly has a lid structure that has a pair of lid support members that are joined to the lid at a corresponding side of the lid. The lid assembly further includes a pair of pivot support members that are configured to be joined to the inner side of the opening in the article. Each pivot support member has an inner side and a pivot pin member joined to the inner side. The lid structure is attached to the pivot pin members and pivotal between a closed portion and an opened portion. The lid structure pivots in a first direction to attain the closed position and in an opposite, second direction to attain an opened position. At least one stop member is joined to a corresponding pivot support member to prevent the lid structure from pivoting beyond a first predetermined distance. The lid structure rests upon the stop member when the lid structure is in the closed position. At least one interfering member is joined to one of the pivot support members so as to prevent the lid structure from pivoting in the second direction for a distance that is greater than a second predetermined distance.

16 Claims, 7 Drawing Sheets

LID ASSEMBLY FOR BUILT-IN POWER AND COMMUNICATION OUTLET UNIT

CROSS-REFERENCE TO RELATED APPLICATIONS

This application claims the benefit of U.S. Provisional Application No. 60/933,180, filed Jun. 5, 2007. The entire disclosure of the aforesaid application No. 60/933,180 is hereby incorporated by reference.

TECHNICAL FIELD

The present invention generally relates to a lid assembly for a power and communication outlet unit that is mounted to an article of furniture, e.g. desk, table, etc. at a location below the work surface of that article of furniture.

BACKGROUND ART

Power and communication outlet units that are mounted to an article of furniture, e.g. desk, table, etc. at a location below the work surface of the article of furniture are known in the art. These power and communication outlet units are typically mounted in a cut-out formed in the work surface of the article of furniture, such as a desk, workbench, table, work station, etc. such that the panel having the power and communication outlets are located below the work surface, but which are easily accessible to a user. The power and communication outlet unit typically has a lid that is used to cover the unit when not in use. The outer surface of the lid functions as a continuation of the work surface when the lid is closed. Thus, the user can actually place equipment or other items right on top of the lid when it is closed.

DISCLOSURE OF THE INVENTION

The present invention is directed to a new and improved lid assembly for a power and communication outlet unit of the type described in the foregoing description.

Specifically, the present invention is directed to a lid assembly for a power and communication outlet unit built into an article such as a desk, table, work bench, work station or similar article having a work surface wherein the power and communication outlet is positioned below an opening or cut-out in the work surface wherein the opening has an inner side that extends about the opening. The lid assembly comprises a lid structure that comprises a lid having a top surface, a bottom surface, a pair of sides, a front portion and a rear portion. The lid structure further comprises a pair of lid support members. Each lid support member is attached to a corresponding side of the lid. The lid assembly further includes a pair of pivot support members. Each pivot support member is configured to be attached to the inner side of the opening in the article. Each pivot support member has an inner side and a pivot pin member attached to the inner side. The lid structure is pivotally attached to the pivot pin members and pivots between a closed portion and an opened position. The lid structure pivots in a first direction for a first predetermined distance to attain the closed position and in an opposite, second direction for a second predetermined distance to attain a complete opened position. At least one stop member is attached to a corresponding pivot support member to prevent the lid structure from pivoting beyond the first predetermined distance. The lid structure rests upon the stop member when the lid structure is in the closed position. At least one interfering member is attached to one of the pivot support members so as to prevent the lid structure from pivoting in the second direction for a distance that is greater than the second predetermined distance.

Advantages and further features of the present invention are described in the ensuing description.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

BEST MODE FOR CARRYING OUT THE INVENTION

Figure 1:
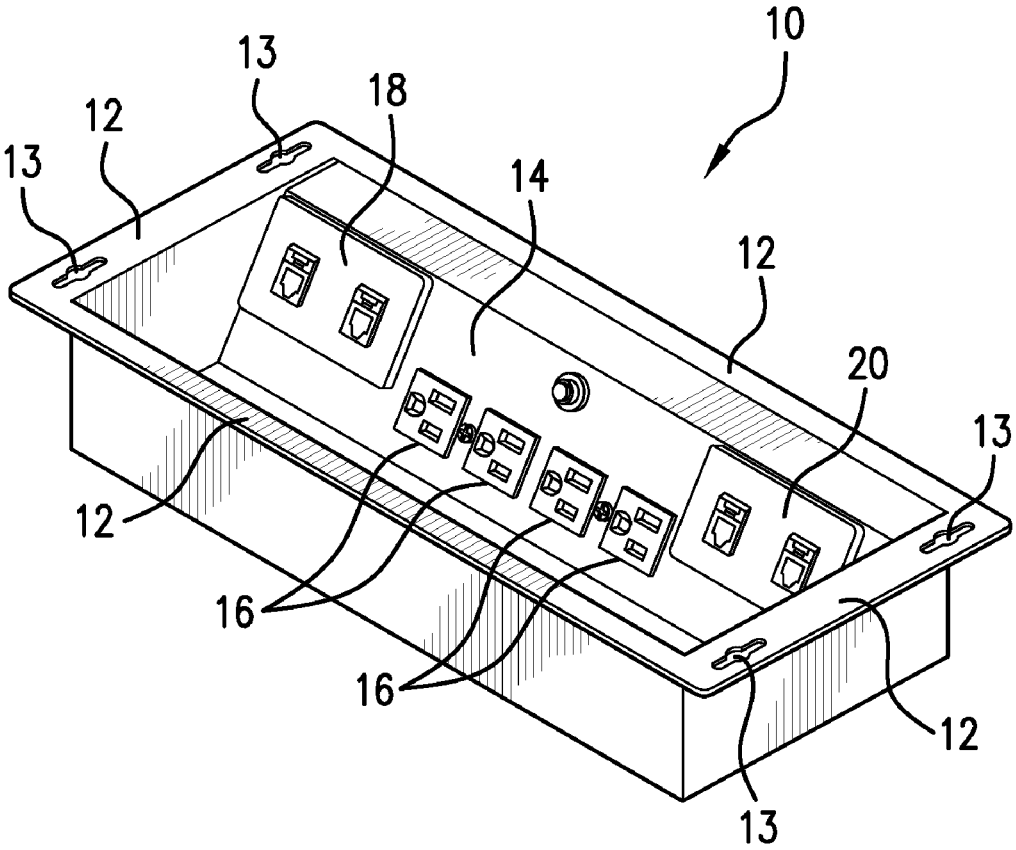
FIG. 1 is a perspective view of a power and communication outlet unit with which the lid assembly of the present invention is used.

Referring to FIG. 1, there is shown a power and communication outlet unit 10 that is configured to be mounted under a work surface of a table, desk, workbench, work station or similar article of furniture. Unit 10 has top edge surface 12. Screws (not shown) are inserted through openings 13 in top edge surface 12 and fastened to the bottom side of the work surface. Unit 10 comprises panel 14 and a plurality of power outlets or receptacles 16 and communication outlets 18 and 20 (also known as RJ45 outlets) that are connected to panel 14. Power outlets 16 provide A.C. voltage (e.g. 117 VAC) to power office or laboratory equipment, e.g. personal computers, oscilloscopes, etc. Communication outlets 18 and 20 provide connection to a communication network such as a telephone communication network or the internet.

Figure 2:
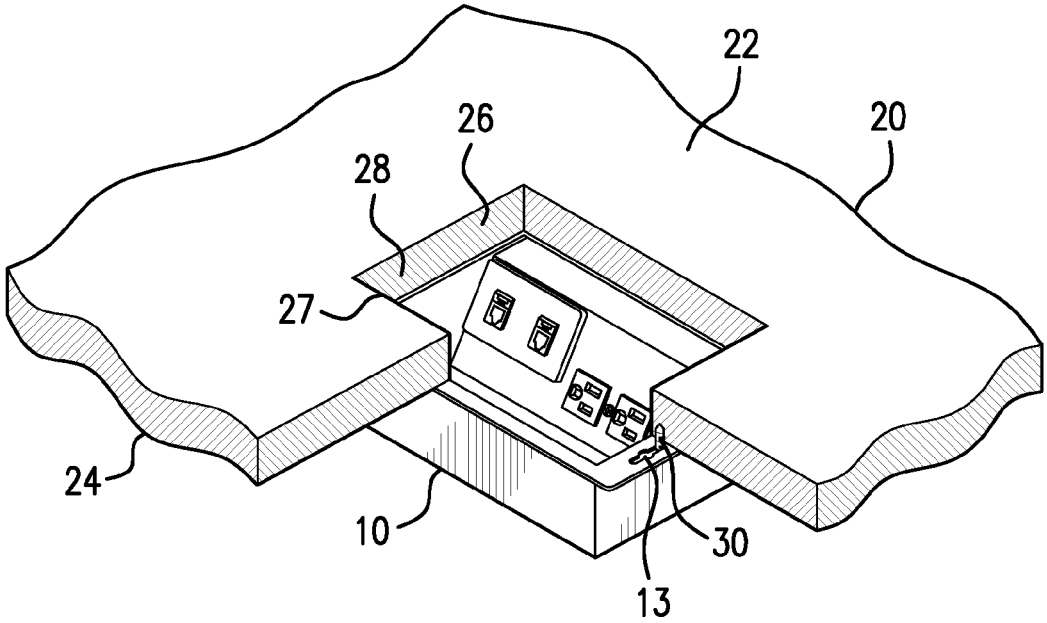
FIG. 2 is a perspective view showing the outlet unit of FIG. 1 mounted under a work surface of an article of furniture and aligned with a cut-out formed in the work surface.

Referring to FIG. 2, unit 10 is attached to an article of furniture 20 (e.g. table, desk, workbench, work station, etc.) that has a work surface 22, bottom side 24 and a opening or cut-out 26 that extends through the article of furniture 20. Cut-out 26 has a perimetrical edge 27, an inner, widthwise side 28 and an inner widthwise side that is opposite to side 28 but which is not shown in the drawings. Unit 10 is attached to bottom side 24 via screws 30 that are inserted through openings 13 and fastened to bottom side 24.

Figure 3:
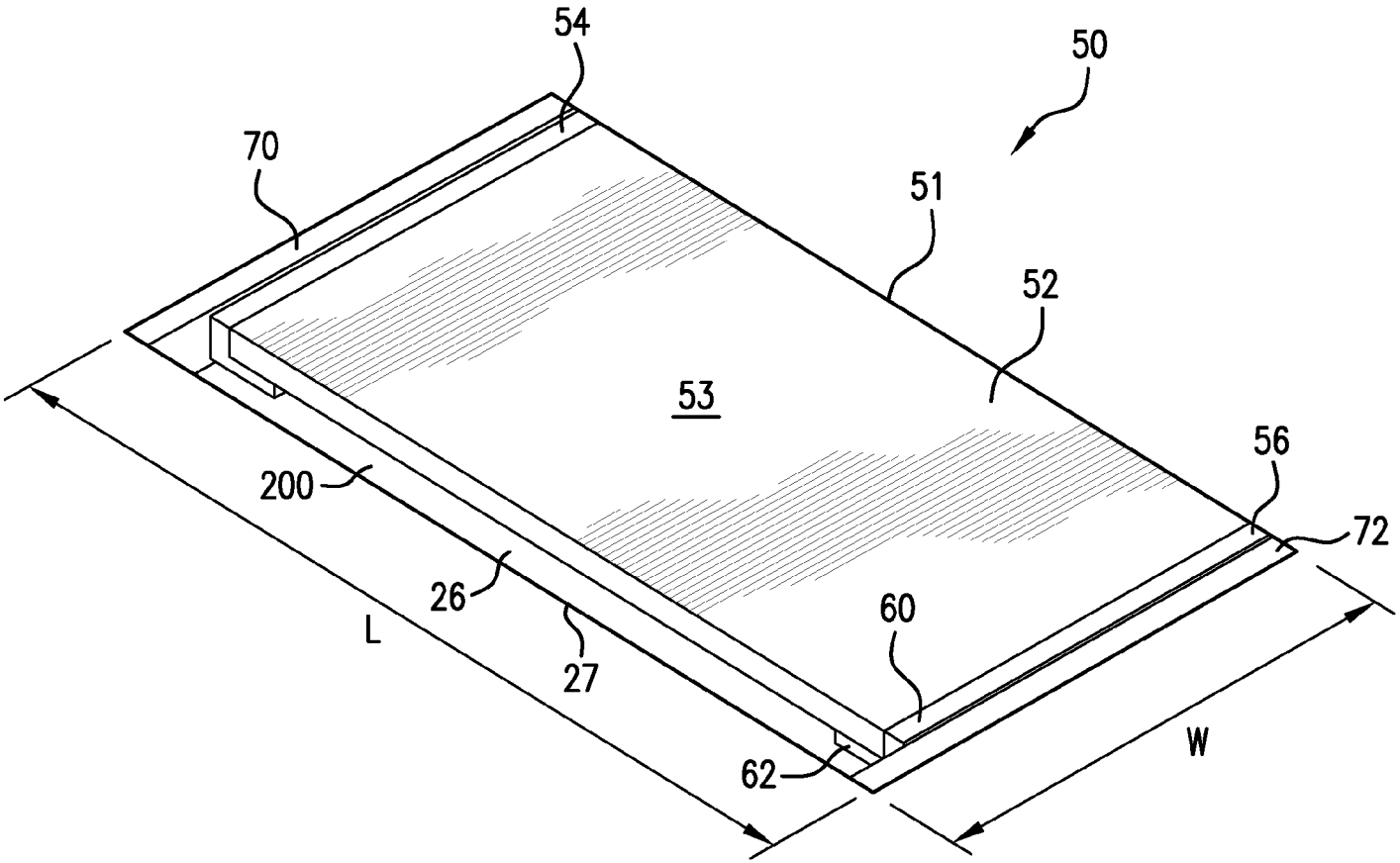
FIG. 3 is a perspective view of the lid assembly of the present invention, the lid assembly being operatively mounted within the cut-out in the work surface.

Referring to FIG. 3, there is shown lid assembly 50 in accordance with one embodiment of the present invention. Lid assembly 50 comprises lid structure 51. Lid structure 51 comprises lid or top member 52. In a preferred embodiment, lid 52 has a substantially planar, top surface 53. Lid 52 may be fabricated from any one of a variety of suitable materials, e.g. glass, wood, aluminium, plastic, etc. Lid structure 51 further comprises lid support members 54 and 56. Lid structure 51 has a length L and a width W which can be varied depending upon the application. Each lid support member 54 and 56 has a generally "L" shape and is attached to a respective side of lid 52. The manner of attaching each lid support members 54 and 56 to lid 52 depends upon the material from which lid 52 is fabricated. For example, if lid 52 is fabricated from glass, then adhesives can be used to bond lid support members 54 and 56 to the glass. In another example, if lid 52 is fabricated from wood, then adhesives, screws or nails can be used to attach lid support members 54 and 56 to lid 52. Lid support members 54 and 56 may be fabricated from wood, plastic, resin, metal, composite materials, etc. In one embodiment, lid support members 54 and 56 are fabricated from aluminium.

Figure 4A:
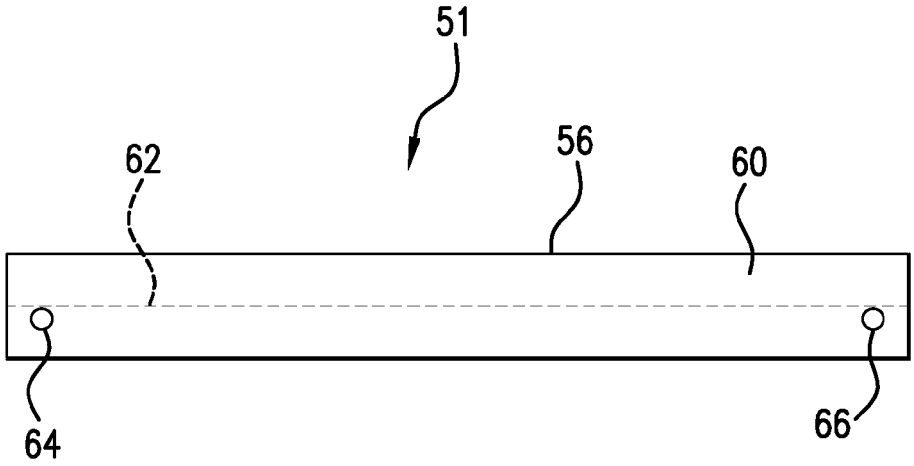
FIG. 4A is a side view of the lid structure shown in FIG. 3.
Figure 4B:
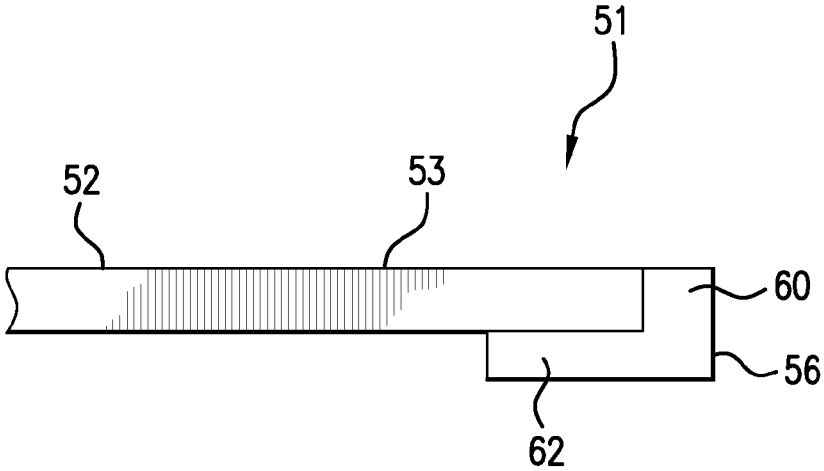
FIG. 4B is a partial, front view of the lid structure.

Referring to FIGS. 4A and 4B, there is shown lid structure 51 having lid support members 54 and 56 attached thereto. Lid support members 54 and 56 are identically constructed and therefore, only lid support member 56 is described. Lid support member 56 has a generally "L" shape and comprises a vertical section 60 and a horizontal section 62. Lid support member 56 includes pivot pin entry holes 64 and 66.

Figure 6:
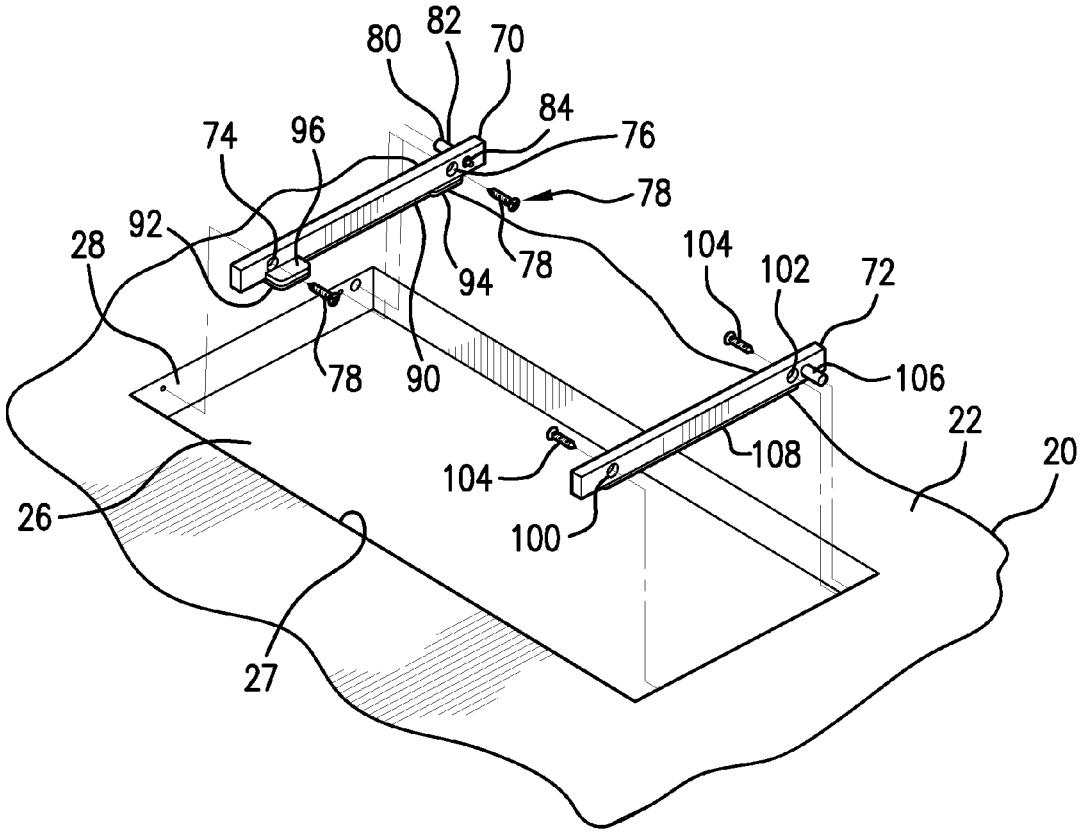
FIG. 6 is a perspective view illustrating how the pivot support members of the lid assembly are attached to the sides of cut-out formed in the work surface.

Referring to FIG. 6, lid assembly 50 further comprises pivot support members 70 and 72. Lid structure 51 is pivotally attached to pivot support members 70 and 72. Lid structure 51 pivots between a closed position and an open position. Specifically, lid structure 51 pivots in a first direction for a first predetermined distance to attain the closed position. Lid structure 51 can also pivot in an opposite, second direction for a second predetermined distance to attain a full or complete opened position. Pivot support members 70 and 72 are identical in construction. Pivot support member 70 has through-holes 74 and 76 for receiving screws 78. Screws 78 are used to attach pivot support member 70 to side 28 of cut-out or opening 26. Pivot support member 70 further comprises pivot pin member 80 that comprises body portion 82 and pin member 84. Pivot support member 70 further includes elongate member 90 that is attached to the bottom of pivot support member 70. Elongate member 90 has extending lip portions 92 and 94. Lip portion 92 functions as a stop member and prevents lid structure 51 from pivoting a distance greater than the first predetermined distance. A resilient pad 96 is attached to the top of lip portion 92. Resilient pad 96 is fabricated from a shock absorbing material, e.g. rubber, which forms a cushion for lid assembly 51 when lid assembly 51 is closed. Extending lip portions 92 and 94 function to prevent lid structure 51 from falling into cut-out 26 (see FIG. 2) while lid structure 51 is being pivotally mounted to pivot support members 70 and 72. Extending lip portion 94 has an additional function that is described in the ensuing description.

Referring to FIG. 6, in a preferred embodiment, pivot pin 80 comprises a spring member (not shown) that is internal to body section 82. This internal spring member urges pin 84 outward. Pivot pin member 80 is constructed so that the force of the internal spring (not shown) cannot dislodge pin 84 from body section 82. Thus, pin 84 can be pushed inward in order to install lid structure 51. Pivot support member 72 is identical in construction to pivot support member 70 and thus, also comprises through-holes 100 and 102 for receiving screws 104. Pivot support member 72 further comprises pivot pin member 106. Pivot pin member 106 has a body portion (not shown but substantially the same as body portion 82) and a pin member (not shown but substantially the same as pin member 84). Pivot support member 72 also has elongate member 108 which is attached to the bottom of pivot support member 72 and has the same structure and function as elongate member 90. Specifically, elongate member 108 has lip portions (not shown) that are substantially the same as extending lip portions 92 and 94. Lip portion 94 and the corresponding lip portion on elongate member 108 both function to interfere with the movement of lid structure 51 so as to prevent lid structure 51 from pivoting beyond the aforesaid second predetermined distance that lid structure 51 must travel in order to attain the complete, full opened position. Thus, lip portion 94 and the corresponding lip portion on elongate member 108 function to limit the range in which lid structure 51 can pivot in the opposite, second direction. Specifically, as lid structure 51 is opened, the front portion of lid structure 51 moves upward and, as a consequence, the rear portion of lid structure 51 moves downward. Eventually, the bottom, rear portion of lid support member 54 will strike lip portion 94, and the bottom, rear portion of lid support member 56 will strike the corresponding lip portion (not shown) on elongate member 108, thereby preventing lid structure 51 from pivoting beyond the second predetermined distance. In a preferred embodiment, lip portion 94 and the corresponding lip portion (not shown) on elongate member 108 are positioned and configured so that lid structure 51 pivots in the opposite, second direction not more than 110 degrees with respect to the longitudinally extending axes of pivot support members 70 and 72.

Figure 5:
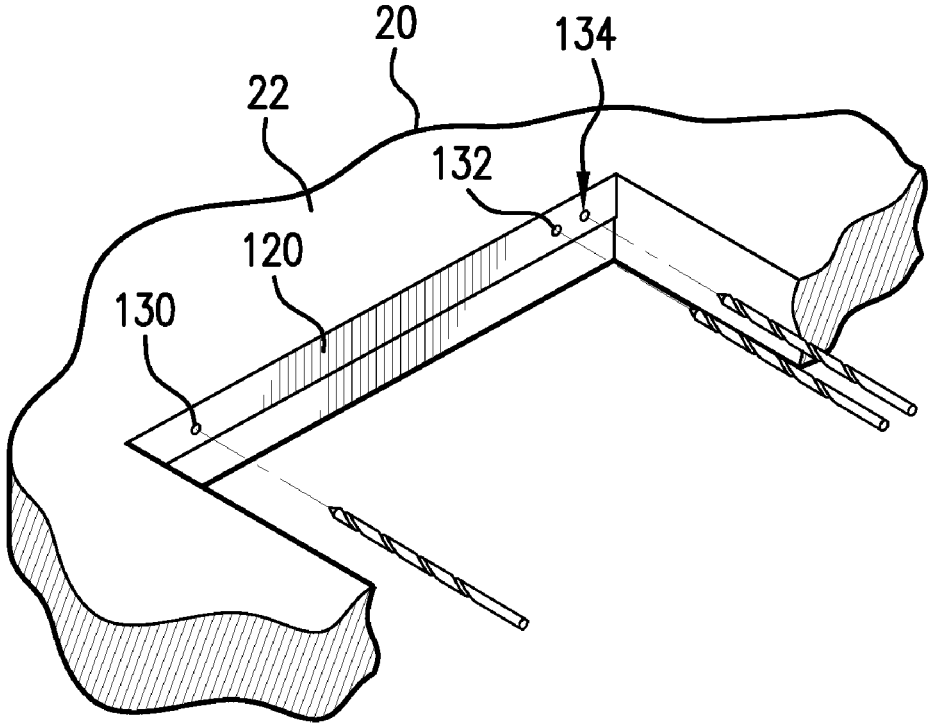
FIG. 5 is a perspective view that illustrates the manner of installing the lid assembly of the present invention within the cut-out in the work surface.

Referring to FIG. 5, template 120 is used to form holes in side 28 of cut-out or opening 26 and in the side of cut-out 26 that is opposite to side 28. Holes 130 and 132 are formed in side 28 and are sized for receiving screws 78. Pivot hole 134 is formed in side 28 and is sized to receive body section 82 of pivot pin member 80.

Figure 7:
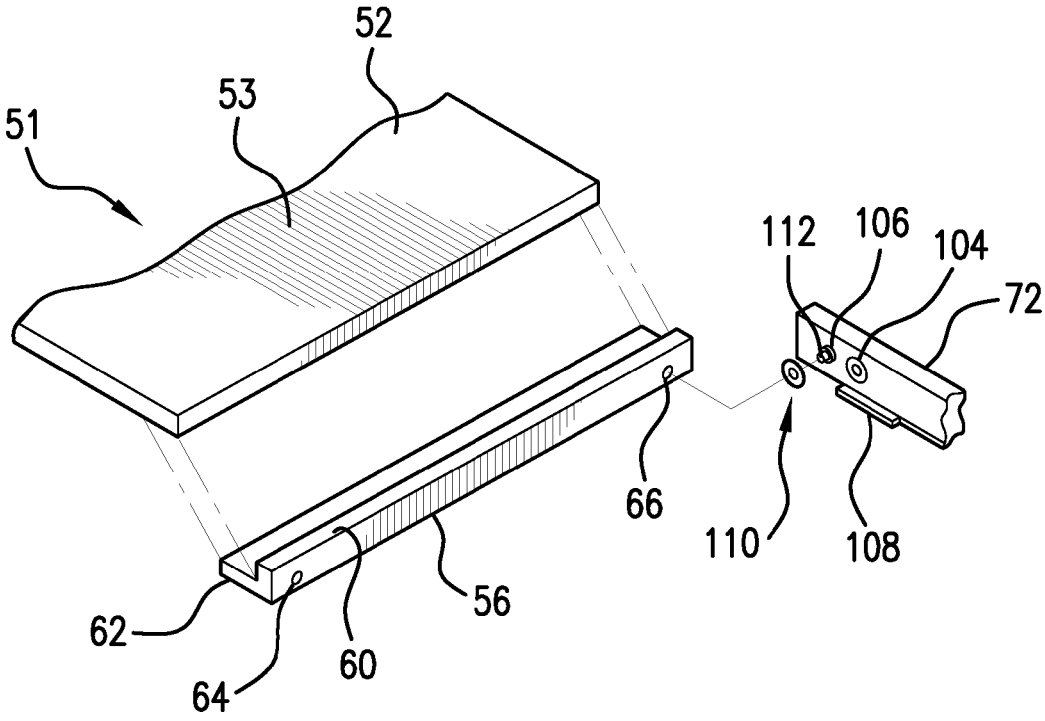
FIG. 7 is a perspective view illustrating how the lid structure is pivotally attached to the pivot support members.

FIG. 7 illustrates how lid structure 51 is pivotally mounted to pivot support members 70 and 72. Although FIG. 7 shows just pivot support member 72, it is to be understood that lid structure 51 is pivotally mounted to pivot support member 70 in the same manner. Washer 110 is placed on pin 112 of pivot pin member 106. Lid structure 51 is then oriented so that pin 112 is inserted into pivot hole 66 in lid support member 56. Pin 84 of pivot pin member 80 (of pivot support member 70) can then be depressed so as to allow lid structure 51 to be fitted between pivot support members 70 and 72. Once pivot pin 84 is aligned with the corresponding pivot hole in lid support member 54, the internal spring (not shown) of pivot pin member 80 pushes pin 84 outward and into the corresponding pivot hole in lid support member 54. Since lid structure 51 is symmetrically constructed, lid structure 51 can be rotated 180° so that pin 84 is disposed into pivot hole 64 of lid support member 56.

Referring to FIG. 3, there is shown lid assembly 50 completely installed in cut-out 26. Lid structure 51 is pivotally mounted to pivot support members 70 and 72. In a preferred embodiment, the width W of lid structure 51 provides for an access space or opening 200 between the edge 27 of cut-out 26 and lid structure 51 when lid structure 51 is closed. When lid structure 51 is opened, an A.C. voltage cord or cords can be plugged into power outlets 16 and/or a cable or wire can be plugged into communication outlets 18 and/or 20. Lid structure 51 can then be closed and access space or opening 200 allows A.C. voltage cords and/or communication cables to remain plugged into their corresponding outlets on panel 14. Thus, while lid structure 51 is closed, A.C. power cords and communication cables or wires that are connected to electrical equipment located on work surface 22 extend through access space or opening 200 and into cut-out 26 where they are plugged into the corresponding outlets.

When lid structure 51 is closed, the top surface 53 functions as a continuation of work surface 22 and thus, the user may place equipment or other items on top surface 53.

While the foregoing description is exemplary of the present invention, those of ordinary skill in the relevant arts will recognize the many variations, alterations, modifications, substitutions and the like are readily possible, especially in light of this description, the accompanying drawings and the claims drawn hereto. In any case, because the scope of the invention is much broader than any particular embodiment, the foregoing detailed description should not be construed as a limitation of the present invention, which is limited only by the claims appended hereto.

What is claimed is:

1. A lid assembly for a power and communication outlet apparatus having at least one power or communication outlet, wherein the power and communication outlet apparatus is attached to the underside of an article of furniture, wherein the article of furniture has a work surface and an opening in the work surface and wherein the power and communication outlet is accessible through said opening and wherein said opening has an inner perimetrical wall, the lid assembly comprising:

a lid structure comprising a lid having a top surface, a bottom surface, a pair of sides, a front portion and a rear portion, the lid structure further comprising a pair of lid support members, each lid support member being attached to a corresponding side of the lid;

a pair of pivot support members, each pivot support member being configured to be attached to the inner perimetrical wall of the opening in the work surface, each pivot support member having an inner side and a pivot pin member extending from the inner side, the lid structure being pivotally attached to the pivot pin members and pivotal between a closed portion and an opened portion, the lid structure pivoting in a first direction for a first predetermined distanced to attain the closed position and in a second direction for a second predetermined distance to attain a complete opened position;

at least one front lip member attached to a pivot support member for contacting the lid structure and blocking the lid structure from pivoting beyond the first predetermined distance, the lid structure resting upon the front lip member when the lid structure is in the closed position; and at least one rear lip member attached to one of the pivot support members for contacting the lid structure and blocking the lid structure from pivoting in the second direction for a distance that is greater than the second predetermined distance, the lid structure contacting the rear lip member when the lid structure is in the complete open position.

2. The lid assembly according to claim 1 wherein the pivot support member has a bottom side and wherein the lid assembly further comprises an elongate member that is attached to the bottom side of the pivot support member, the at least one front lip member being attached to the elongate member.

3. The lid assembly according to claim 2 wherein each lid support member has a generally "L" shaped cross-section.

4. The lid assembly according to claim 1 further comprising a resilient pad attached to the at least one front lip member that contacts the lid structure when the lid structure is in the closed position.

5. The lid assembly according to claim 1 wherein the pivot support member has a front portion and a rear portion, the at least one front lip member being in proximity to the front portion.

6. The lid assembly according to claim 1 wherein the at least one front lip member comprises a pair of front lip members, wherein each front lip member is attached to a corresponding pivot support member.

7. The lid assembly according to claim 1 wherein the pivot support member has a bottom side and the lid assembly further comprises an elongate member attached to the bottom side of the pivot support member, and wherein the at least one rear lip member is attached to the elongate member.

8. The lid assembly according to claim 1 wherein the pivot support member has a front portion and a rear portion, the at least one rear lip member is in proximity to the rear portion.

9. The lid assembly according to claim 1 wherein the at least one rear lip member comprises a pair of rear lip members, wherein each rear lip member is attached to a corresponding pivot support member.

10. The lid assembly according to claim 1 wherein each lid support member comprises a first portion that contacts a corresponding side of the lid and a second portion that contacts the bottom side of the lid.

11. The lid assembly according to claim 1 wherein the lid has a substantially planar geometry.

12. The lid assembly according to claim 1 wherein the lid is fabricated from wood.

13. The lid assembly according to claim 1 wherein the lid is fabricated from plastic.

14. The lid assembly according to claim 1 wherein the lid is fabricated from glass.

15. The lid assembly according to claim 14 wherein each lid support member is fabricated from metal.

16. An article of furniture comprising:

a top side that defines a work surface;

a bottom side;

said article of furniture including a through-hole extending from the work surface to the bottom side, the through-hole having an inner perimetrical wall;

a power and communication outlet apparatus attached to the bottom side of the article of furniture and positioned under the through-hole, the power and communication outlet apparatus having at least one power or communication outlet, wherein the power or communication outlet is accessible through the through-hole;

a lid structure comprising a lid having a top surface, a bottom surface, a pair of sides, a front portion and a rear portion, the lid structure further comprising a pair of lid support members, each lid support member being attached to a corresponding side of the lid;

a pair of pivot support members, each pivot support member being configured to be attached to said inner perimetrical wall of the through-hole, each pivot support member having an inner side and a pivot pin member extending from the inner side, the lid structure being pivotally attached to the pivot pin members and pivotal between a closed portion and an opened position, the lid structure pivoting in a first direction for a first predetermined distanced to attain the closed position and in a second direction for a second predetermined distance to attain a complete opened position, wherein the lid structure covers and conceals the at least one power or communication outlet when the lid structure is in the closed position;

at least one front lip member attached to a pivot support member for contacting the lid structure and blocking the lid structure from pivoting beyond the first predetermined distance, the lid structure resting upon the front lip member when the lid structure is in the closed position; and at least one rear lip member attached to one of the pivot support members for contacting the lid structure and blocking the lid structure from pivoting in the second direction for a distance that is greater than the second predetermined distance, the lid structure contacting the rear lip member when the lid structure is in the complete open position.

* * * * *